US006050701A

United States Patent [19]

Stone

[11] Patent Number: 6,050,701

[45] **Date of Patent: *Apr. 18, 2000**

[54] DECORATIVE LIGHTING SYSTEM

[76] Inventor: Juanita Stone, 788 W. Fair Oaks Rd., New Castle, Ind. 47362

[ * ] Notice: This patent issued on a continued prosecution application filed under 37 CFR 1.53(d), and is subject to the twenty year patent term provisions of 35 U.S.C. 154(a)(2).

[21] Appl. No.: 08/790,604

[22] Filed: Jan. 29, 1997

Related U.S. Application Data

[60] Provisional application No. 60/010,978, Feb. 1, 1996.

[51] Int. Cl.[7] ..... F21V 21/00

[52] U.S. Cl. ..... 362/249; 362/391; 362/396; 362/806

[58] Field of Search ..... 362/249, 252, 362/396, 806, 123, 145, 391; 206/419, 226; 248/6.5, 73

[56] References Cited

U.S. PATENT DOCUMENTS

| | | | |
|---|---|---|---|
| 3,193,229 | 7/1965 | Stock | 248/72 |
| 4,714,219 | 12/1987 | Mayse | 362/249 |
| 4,720,773 | 1/1988 | Ahroni | 362/249 |
| 4,901,212 | 2/1990 | Prickett | 362/249 |
| 5,150,964 | 9/1992 | Tsui | 362/249 |
| 5,624,180 | 4/1997 | Lanning | 362/249 |

*Primary Examiner*—Thomas M. Sember
*Attorney, Agent, or Firm*—Brinks Hofer Gilson & Lione

[57] ABSTRACT

A modular support system for a lighting system which includes a mounting bracket for supporting a strand of lights in a pattern. The mounting bracket includes a plurality of integrally formed clips for retaining corresponding longitudinal sections of light strand in the desired pattern irrespective of the position in which the mounting bracket is secured.

11 Claims, 2 Drawing Sheets

DECORATIVE LIGHTING SYSTEM

RELATED PRIORITY APPLICATION

This application claims the benefit of U.S. Provisional Application Ser. No. 60/010,978, filed Feb. 1, 1996.

BACKGROUND AND SUMMARY OF THE INVENTION

The present invention relates to a lighting system, and particularly to a bracket system for supporting a strand of lights. More particularly, the present invention relates to a lighting system for displaying a strand of lights in a pre-determined decorative manner which creates a "water-fall" effect when lit.

It is well known to hang strands of decorative lights on trees and shrubbery during various holidays and seasons. Often times, individuals also desire to decorate the facades of their homes, windows, porches and the like with decorative lighting patterns. To decorate such areas with lighting patterns such as water-falls or lacy lights, it is often necessary to first determine what spacing-achieves the best lighting effect. The surface is then marked with the pre-selected spacing measurements and multiple nails are hammered into the surface at the selected markings. This lengthy procedure must be completed prior to hanging the first light. Such a complicated decorating procedure is quite time consuming and can be tedious, especially in cold weather.

In addition, it is often undesirable to mar the exterior of the house with numerous nail holes. To limit marring of the house, individuals have hammered the nails into a wooden plank which is then attached to the house. These planks have proved undesirable, however, because wind and accidental jerking of the lights easily causes the strand of lights to fall off of the supporting nail. An accidental jerking of the lights can also cause one or more of the nails to be pulled out of the surface. Moreover, wooden strips, when left in the weather, eventually become rotten and break. What is needed is a one-piece lighting system which can be left in the weather throughout the year and which allows a user to rapidly and easily mount strands of lighting on a desired surface in a decorative "water-fall" pattern, with minimal marring of the surface.

One object of the present invention is to provide a lighting system that includes a mounting bracket having an elongated center portion, a series of clips which are positioned in a set spaced-apart relationship relative to one another along the center portion, and a strand of lights suitable for draping over the clips so that bight portions are formed in the strand which are equally spaced-apart to create a desirable lighting effect.

Another object of the present invention is to provide a mounting bracket having an elongated center portion and multiple clips positioned in spaced-apart relationship along the length of the strip, the bracket being formed to support a strand of lighting thereon in a manner which causes bight portions to be formed in the strand which are positioned in a equidistant spaced-apart relationship relative to one another.

According to the present invention a lighting system is provided that includes a strand of lights, a mounting bracket having opposite ends and a center portion extending between the opposite ends, and a plurality of clips positioned in a set and pre-determined spaced-apart relationship to one anther on the center portion of the mounting bracket. The strand of lights includes an insulated wire having opposite ends and a plurality of light bulbs positioned in a spaced-apart relationship along the wire between the opposite ends. In addition, the clips are set on the center portion so that the clips cause bight portions to be formed in the lighting strand which are positioned in an equidistant spaced-apart relationship relative to one another.

According to another embodiment of the present invention a decorative lighting kit is provided that has component parts capable of being assembled in the field at a surface to be decorated. The kit includes the combination of a mounting bracket having opposite ends and a center portion extending between the opposite ends and a plurality of clips are positioned in a set spaced-apart relationship to one another on the center portion. This mounting bracket is adapted to be affixed to the surface. Moreover, a strand of lights is adapted to be positioned over the clips in a manner which creates an upper bight portion engaging each clip and lower bight portions positioned in an off-set relationship relative to the upper bight portions.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
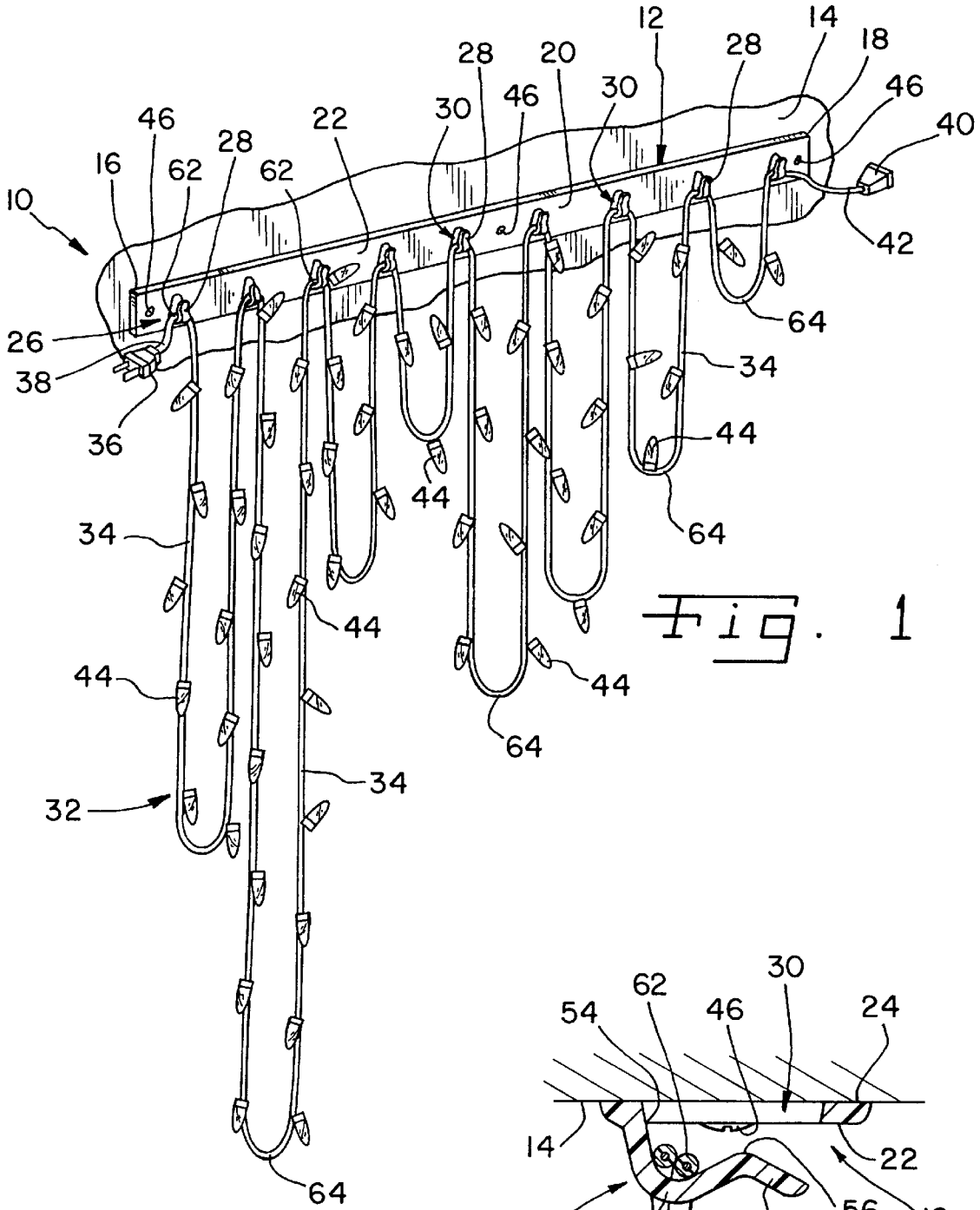
FIG. 1 is a perspective view of a lighting system in accordance with the present invention coupled to a surface, the system includes a mounting bracket having a plurality of clips positioned in a pre-determined spaced-apart relationship relative to one another and a strand of lights draped across each clip to form upper and lower bight portions positioned in an off-set spaced-apart relationship relative to one another.

A presently preferred embodiment of a lighting system 10 is shown in FIG. 1. A mounting bracket 12 in accordance with the present invention is included in this system 10 and is mounted preferably as shown on a solid surface 14. Illustratively, the mounting bracket 12 has opposite ends 16, 18 and an elongated center portion 20 extending between the opposite ends 16, 18. In addition, the center portion 20 includes a front face 22 and an opposite back face 24 formed to engage the surface 14. See FIG. 2. Typically, the mounting bracket 12 is constructed of medium impact styrene compound, although it is understood that the mounting bracket 12 may be formed from a wide variety of plastic materials and metals. In addition, the mounting bracket 12 typically has a width of about 1.25 inches (3.18 cm) and a length of about 19 inches (48 cm). Preferably, four mounting brackets 12 are positioned in an end-to-end manner in order to form a continuously extending mounting bracket having a length of about 6 feet (1.8 m). It is understood, however, that the length of the mounting bracket 12 may be varied to achieve various lighting effects.

Figure 2:
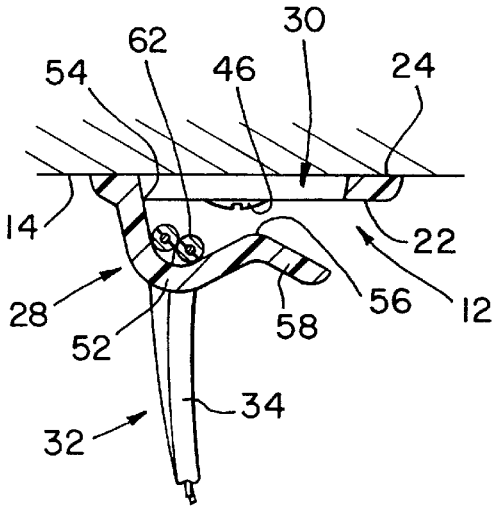
FIG. 2 is a partial cross-sectional view of the lighting system of FIG. 1 mounted on a surface situated as an overhang showing the strand of lights draped over one clip of the mounting bracket so that the strand is held in a secured position.
Figure 3:
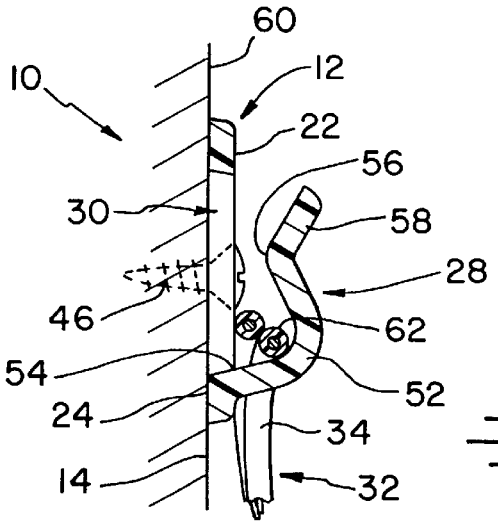
FIG. 3 is a partial cross-sectional view of a lighting system of FIG. 1 mounted on a surface situated as an wall showing a screw extending through the mounting bracket and into the surface and the strand of lights draped over one clip of the mounting bracket so that the strand is held in a secured position.

As shown in FIG. 1, a series of clips 26 are positioned in a predetermined spaced-apart relationship relative to one another along the front face 22 of the center portion 20. Preferably, the series 26 includes nine clips 28. Typically the clips 28 are injection molded from the center portion 20 of the mounting bracket 12. An aperture 30 is positioned between the front and back faces 22, 24 behind each clip 28, as best shown in FIGS. 2–3. It is understood that the clip 28 may be securely formed along the front face 22 of the center portion 20 using a variety of techniques. Non-limiting examples of alternative clips 28 include screw clips securely affixed in the mounting bracket 12 in a manner which permanently secures them in place and metal clips cut from and bent out of the mounting bracket 12. It is necessary that the clips 28 are fixed in a pre-determined position relative to one another. Typically the clips 28 are positioned a set distance of about 2 inches (5.1 cm) from one another. However, it is understood that the clips 28 may be situated at a set distance that is either greater than or less than about 2 inches (5.1 cm) to produce different decorative lighting effects when assembled.

The lighting system 10 also includes a strand of lights 32. See FIG. 1. The strand typically includes a wire 34 having opposite ends, an electrical plug 36 positioned at a first end 38 and an electrical socket 40 positioned at the second end 42. In addition, a plurality of light bulbs 44 are positioned in a spaced-apart relationship relative to one another along the wire 34. It is understood that the strand of lights 32, when lit may create a continuous light or may blink in a pre-selected pattern. Moreover, non-limiting examples of colors generated by the light bulbs 44 include white, pastel, red, blue, green, yellow, orange, or multi-colored. It is understood that the strand of lights 32 may be selected depending upon the season of the year or the upcoming holiday to match the traditional season or holiday colors. For example, once attached to the surface 14, the mounting bracket 12 may remain in place throughout the year and the strands 32 may be replaced depending upon the occasion. For example, clear and multi-colored bulbs 44 may be draped across the series of clips 26 during Christmas; red colored bulbs 44 may be used for Valentines Day; green colored bulbs 44 may be used for St. Patrick's Day; pastel colored bulbs 44 may be used during Easter; red, white, and blue bulbs 44 may be used for Memorial Day, Independence Day, Flag Day, and Veteran's Day; and autumn colored bulbs 44 may be used for Thanksgiving.

Figure 4:
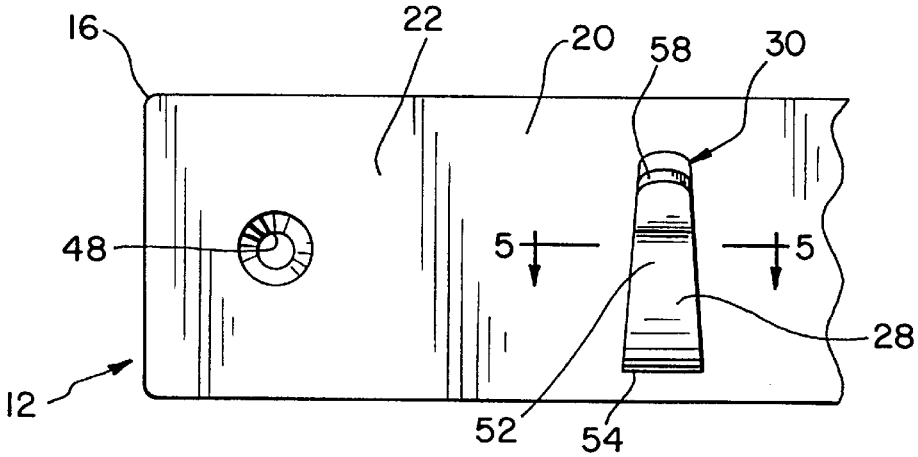
FIG. 4 is an enlarged partial front view of the mounting bracket of FIG. 1 showing the bracket having a slot that is sized for receiving a screw therethrough and a clip positioned thereon.

The system 10 of the present invention may be mounted on surfaces 14 situated in several positions. See FIGS. 1–3. It is understood that the mounting bracket 12 and the strand of lights 32 may be combined in a kit that is capable of being assembled in the field at the surface 14 to be decorated. Referring now to FIG. 1, the mounting bracket 12 is adapted to be mounted on the surface 14 by attachment screws 46 that extend through slots 48 (see FIG. 4) formed in the mounting bracket 12. Typically, the mounting bracket 12 is formed to include three slots 48 therethrough. It is understood that a wide variety of attachment means may extend through the slots 48. Non-limiting examples of attachment means include wood screws, metal or aluminum screws, nails, rivets, rods, pins, staples, or devices commonly used for attaching objects onto a solid support.

Figure 5:
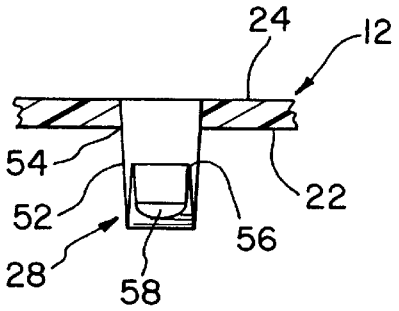
FIG. 5 is a view taken along lines 5—5 of FIG. 4 showing the clip having a pocket portion extending outwardly from a center portion of the mounting bracket and a tab portion formed to prevent sliding movement of the strand off of the clip.

As shown in FIG. 2, the mounting bracket 12 may be mounted on surface 14 positioned as a typical ceiling or overhang structure 50. Typically the overhang 50 is positioned in a substantially perpendicular position relative to the dangling strand of lights 32. The strand of lights 32 is held by a pocket portion 52 of the clip 28 that extends away form the elongated center portion 20 of the mounting bracket 12. As best shown in FIGS. 2, 3, and 5 the pocket portion 52 includes an inner edge 54 positioned adjacent the center portion 20 and an opposite outer edge 56. Moreover, the clip 28 includes a tab 58 (see FIG. 5) extending from the outer edge 56 of the pocket portion 52. Typically the tab 58 jets away from the mounting bracket 12. It is understood that the tab 58 may also be formed to include means for selectively coupling the mounting bracket 12 to fasten the lighting strand 32 within the pocket portion 52 (not shown).

FIG. 3 illustrates the lighting system 10 mounted on the surface 14 positioned as a wall or support structure 60. Typically the wall 60 is positioned in a substantially parallel position relative to the dangling strand of lights 32. The mounting bracket 12 is securely held in position by a screw 46 that extends into the wall. Moreover, the strand of lights 32 is draped through the clip 28 and situated in the pocket portion 52 adjacent the inner edge 54.

To use the lighting system 10 of the present invention, the user, grasps the mounting bracket 12 and situates it against the surface 14 that is to be decorated. The mounting screws 46 are then inserted through the respective mounting slots 48 in order to securely attach the mounting bracket 12 onto the surface 14. Once the mounting bracket 12 is in place, the user may simply drapes the strand of lights 32 across the clips 28 so that upper bight portions 62 are created in the strand 32. These U-shaped bight portions 62 are situated in a substantially equidistant spaced-apart relationship relative to one another and are positioned adjacent the center portion 20 of the mounting bracket 12. Moreover, lower bight portions 64 are created in the strand of lights 32 and are positioned in an off-set spaced-apart relationship relative to the upper bight portions 62. It is understood, however, that given the relative positioning of the clips 28, the upper bight portions 62 have a diameter that is less than the diameter of the lower bight portions 64.

To create the desired water-fall effect, the strand of lights 32 are typically positioned so that the lower bight porions 64 are positioned at various distances from the upper bight portions 62. See FIG. 1. However, it is understood that the relative distances between the upper bight portions 62 and the lower bight portions 64 may be varied in order to accommodate various user's tastes.

Although the invention has been described in detail with reference to certain preferred embodiments, variations and modifications exist within the scope and spirit of the invention as described and defined in the following claims.

I claim:

1. A lighting system, comprising:

a mounting bracket having opposite ends and a central portion extending between the opposite ends, and a plurality of integrally formed clips positioned in a set spaced-apart relationship to one another in the central portion, said integrally formed clips extending outwardly from the central portion; and a strand of lights carried by the integrally formed clips, said strand of lights having a plurality of upper bight portions engaging the plurality of integrally formed clips and forming a plurality of lower bight portions depending from the upper bight portions;

wherein the integrally formed clips are mold injected from the central portion of the mounting bracket.

2. The system of claim 1, wherein the strands of light create a water-fall or icicle effect.

3. A decorative lighting kit having component parts capable of being assembled in the field at a surface to be decorated, the kit comprising the combination of:

a plastic mounting bracket having opposite ends and a central portion extending between opposite ends, and a plurality of integrally formed hanger portions positioned in a set spaced apart relationship to one another on the central portion, said integrally formed hanger portions extending outwardly from the central portion of the mounting bracket, the central portion being adapted to be affixed to the surface to be decorated, and a strand of lights to be carried by the integrally formed hanger portions, said strand comprising a flexible electrical wiring carrying a plurality of spaced light sockets, said flexible electrical wiring permitting the creation of a plurality of upper bight portions engaging the integrally formed hanger portions and a plurality of lower bight portions depending from the upper bight portions, said integrally formed hanger portions being mold-injected from the central portion of the plastic mounting bracket.

4. A lighting system, comprising:

a mounting bracket providing a plurality of integrally formed hanger portions extending outwardly from the mounting bracket, said integrally formed hanger portions being mold-injected from the central portion of the mounting bracket; and a strand of lights comprising flexible electrical wiring having a plurality of spaced sockets, said strand being adapted to be secured by said integrally formed hanger portions to permit the flexible electrical wiring and plurality of spaced sockets to hang in a plurality of upper and lower bight portions from the integrally formed hanger portions.

5. The lighting system of claim 4, wherein said integrally formed hanger portions are formed in a spaced array along said mounting bracket, extending outwardly from a common face of said mounting bracket.

6. The lighting system of claim 5, wherein said integrally formed hanger portions are spaced at substantially equal intervals along said bracket.

7. The lighting system of claim 4, including means for securing said mounting bracket to a substrate.

8. The lighting system of claim 4, wherein each said integrally formed hanger portion defines a shaped recess for supporting a longitudinal extent of said flexible electric wiring when said mounting bracket is secured to a substrate in substantially any orientation thereto.

9. The lighting system of claim 8, wherein each said integrally formed hanger portion further includes a portion extending toward a face of said mounting bracket to define a restricted opening to said shaped recess.

10. The lighting system of claim 9, wherein each said integrally formed hanger portion resiliently accommodates insertion or withdrawal of said flexible electric wiring.

11. The lighting system of claim 10, further including a tab extending from said integrally formed hanger portion.

* * * * *